US010319511B2

(12) United States Patent
Kim

(10) Patent No.: US 10,319,511 B2
(45) Date of Patent: Jun. 11, 2019

(54) COIL COMPONENT

(71) Applicant: SAMSUNG ELECTRO-MECHANICS CO., LTD., Suwon-si, Gyeonggi-do (KR)

(72) Inventor: Jin Hwan Kim, Suwon-si (KR)

(73) Assignee: SAMSUNG ELECTRO-MECHANICS CO., LTD, Suwon-si, Gyeonggi-do (KR)

( * ) Notice: Subject to any disclaimer, the term of this patent is extended or adjusted under 35 U.S.C. 154(b) by 129 days.

(21) Appl. No.: 15/251,514

(22) Filed: Aug. 30, 2016

(65) Prior Publication Data

US 2017/0169933 A1 Jun. 15, 2017

(30) Foreign Application Priority Data

Dec. 9, 2015 (KR) ..... 10-2015-0174825

(51) Int. Cl.

| | |
|---|---|
| ***H01F 27/29*** | (2006.01) |
| ***H01F 27/28*** | (2006.01) |
| ***H01F 1/03*** | (2006.01) |
| ***H01F 27/255*** | (2006.01) |
| ***H01F 27/32*** | (2006.01) |
| ***H01F 17/00*** | (2006.01) |
| ***H01F 17/04*** | (2006.01) |

(52) U.S. Cl.

CPC ..... *H01F 27/2828* (2013.01); *H01F 1/0306* (2013.01); *H01F 17/0013* (2013.01); *H01F 17/04* (2013.01); *H01F 27/255* (2013.01); *H01F 27/2871* (2013.01); *H01F 27/29* (2013.01); *H01F 27/292* (2013.01); *H01F 27/323* (2013.01); *H01F 2017/048* (2013.01)

(58) Field of Classification Search

CPC .... H01F 27/2832; H01F 27/29; H01F 27/255; H01F 27/2804; H01F 5/03; H01F 2005/043; H01F 1/03; H01F 17/0006; H01F 17/13; H01F 2017/002; H01F 2027/2828; H01F 21/12; H01F 2021/125; H01F 27/04; H01F 29/00; H01F 29/02; H01F 29/025; H01F 29/04; H01F 41/076

USPC ..... 336/200, 192, 223, 150, 233

See application file for complete search history.

(56) References Cited

U.S. PATENT DOCUMENTS 6,762,654 B1 * 7/2004 Tanaka ..... H03H 7/32 333/140
2004/0140528 A1 * 7/2004 Kim ..... H01F 21/12 257/537

(Continued)

FOREIGN PATENT DOCUMENTS

KR 10-2004-0042130 A 5/2004
KR 10-2014-0076958 A 6/2014

*Primary Examiner* — Mang Tin Bik Lian
(74) *Attorney, Agent, or Firm* — Morgan Lewis & Bockius LLP

(57) ABSTRACT

A coil component includes a body; and a coil disposed within the body, wherein the coil includes: a first coil conductor including a first conductor pattern with a planar coil shape and a first lead terminal extended to at least one surface of the body; a second coil conductor including a second conductor pattern with a planar coil shape and a second lead terminal extended to at least one surface of the body; and a connection conductor connecting the first and second coil conductors to each other and including a third lead terminal extended to at least one surface of the body.

15 Claims, 7 Drawing Sheets

(56) References Cited

U.S. PATENT DOCUMENTS

| | | | | |
|---|---|---|---|---|
| 2004/0145442 | A1* | 7/2004 | Matsutani | H01F 21/12 336/200 |
| 2011/0133875 | A1* | 6/2011 | Chiu | H01F 17/0013 336/200 |
| 2013/0249664 | A1* | 9/2013 | Tonoyama | H01F 41/04 336/200 |
| 2014/0167884 | A1 | 6/2014 | Song et al. | |

* cited by examiner

COIL COMPONENT

CROSS-REFERENCE TO RELATED APPLICATION

This application claims the benefit of priority to Korean Patent Application No. 10-2015-0174825, filed on Dec. 9, 2015 with the Korean Intellectual Property Office, the entirety of which is incorporated herein by reference.

BACKGROUND

The present disclosure relates to a coil component.

Recently, in accordance with increasing usage of portable electronic devices, research has been undertaken to extend the lifespans of batteries as long as possible. Several technologies for improving system efficiency and improving battery performance have been actively developed for smartphones and the like. For example, current consumption in batteries has been reduced in accordance with improvements in the performance of semiconductor elements (an application processor (AP), a memory, and the like). The following two technologies have been used in order to improve battery efficiency.

In a first technology, a multiphase converter technology, power inductors used in an output of a converter are connected to each other in parallel to reduce loss at high current and to enable miniaturization of the power inductors. In a second technology, a pulse frequency modulation (PFM) technology, an operating frequency of a converter is slowed or omitted at a low current to reduce loss. The second technology is used in a standby mode of the portable electronic device to reduce loss.

However, the two technologies described above have limitations, in that a circuit must be configured in a relatively complex manner to improve efficiency over an entire band from the low current to the high current.

SUMMARY

An aspect of the present disclosure provides a coil component having improved efficiency over an entire band from a low current to a high current.

According to an aspect of the present disclosure, a coil component may be configured by connecting a plurality of coils having different levels of DC resistance (DCR) and similar levels of inductance (L) to each other in series.

According to an aspect of the present disclosure, a coil component comprises: a body; and a coil disposed within the body. The coil includes: a first coil conductor including a first conductor pattern with a planar coil shape and a first lead terminal extended to at least one surface of the body; a second coil conductor including a second conductor pattern with a planar coil shape and a second lead terminal extended to at least one surface of the body; and a connection conductor connecting the first and second coil conductors to each other and including a third lead terminal extended to at least one surface of the body.

According to another aspect of the present disclosure, a coil component comprises: a body having a first surface and a second surface opposing each other in a first direction, a third surface and a fourth surface opposing each other in a second direction, and a fifth surface and a sixth surface opposing each other in a third direction; a coil disposed within the body and including a first coil conductor having a first conductor pattern with a planar coil shape and having a first lead terminal led out to the first surface of the body, a second coil conductor having a second conductor pattern with a planar coil shape and having a second lead terminal led out to the second surface of the body, and a connection conductor disposed between the first and second coil conductors to connect the first and second coil conductors to each other and having a third lead terminal led out to the third surface of the body; and an electrode disposed on the body and including a first electrode conductor entirety covering the first surface of the body and portions of the third to sixth surfaces of the body, a second electrode conductor entirety covering the second surface of the body and portions of the third to sixth surfaces of the body, and a third electrode conductor covering portions of the third, fourth, fifth and sixth surfaces of the body.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
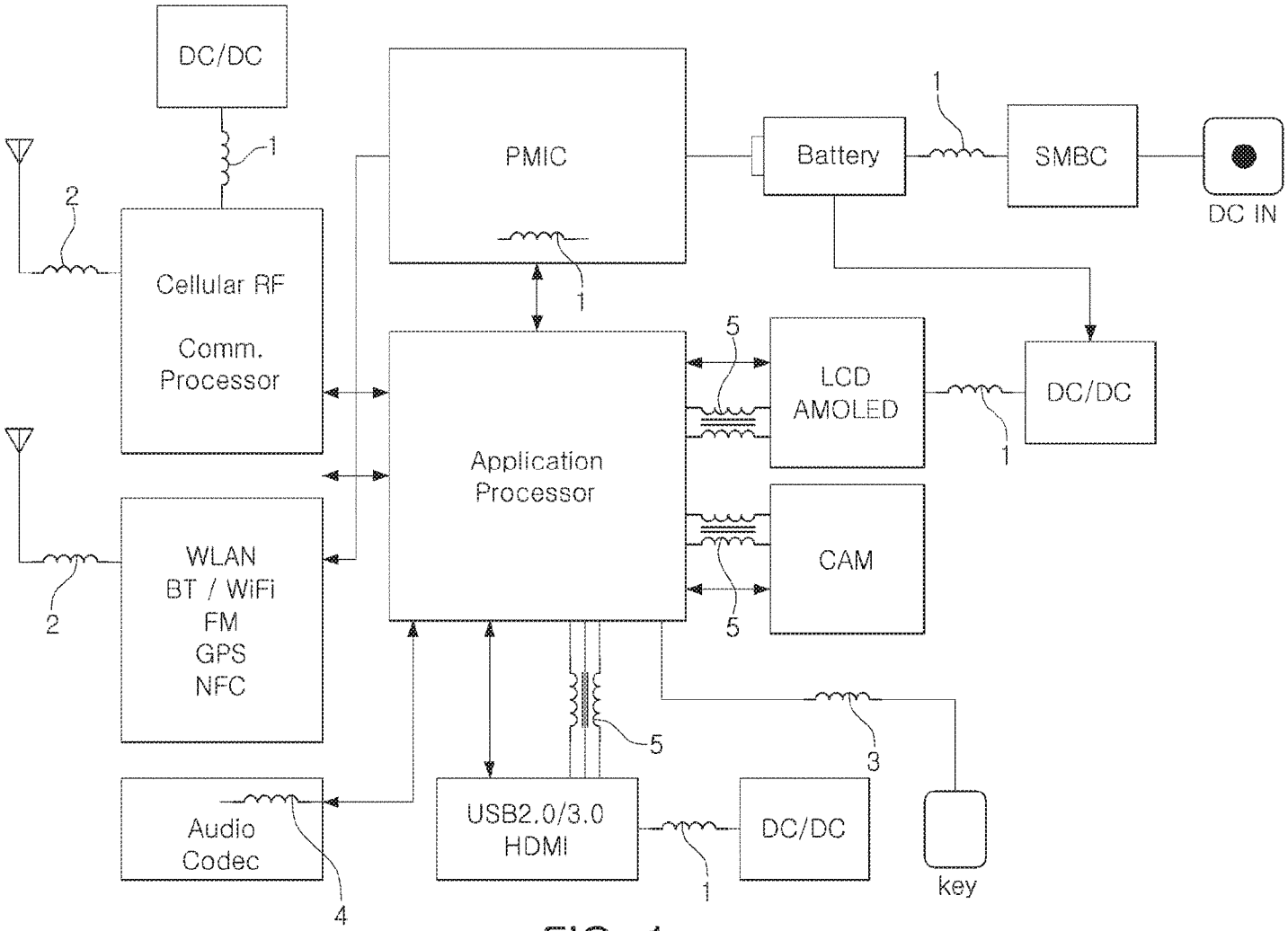
FIG. 1 is a view schematically illustrating examples of coil components used in an electronic device.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present disclosure. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Electronic Device

FIG. 1 is a view schematically illustrating various examples of a coil component used in an electronic device.

Referring to FIG. 1, it may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (Wi-Fi FM GPS NFC), a power management integrated circuit (PMIC), a battery, an SMBC, a liquid crystal display active matrix organic light emitting diode (LCD AMOLED), an audio codec, a universal serial bus (USB) 2.0/3.0 port, a high definition multimedia interface (HDMI) port, a CAM, and the like, may be used. Here, various kinds of coil components may be appropriately used between these electronic components depending on their purposes in order to remove noise, or the like. For example, a power inductor 1, high frequency (HF) inductors 2, a general bead 3, a bead 4 for a high frequency (GHz), common mode filters 5, and the like, may be used. A coil component according to the present disclosure may be these coil components for various purposes.

In detail, the power inductor 1 may be used to store electricity in magnetic field form to maintain an output voltage, thereby stabilizing power. In addition, the high frequency inductor 2 may be used to match impedances to secure a required frequency or to cut out noise and an alternating current (AC) component. In addition, the general bead 3 may be used to remove noise from power and signal lines or remove a high frequency ripple. In addition, the bead 4 for a high frequency (GHz) may be used to remove high frequency noise of a signal line and a power line related to an audio. In addition, the common mode filter 5 may be used to pass a current therethrough in a differential mode and remove only common mode noise.

Figure 2:
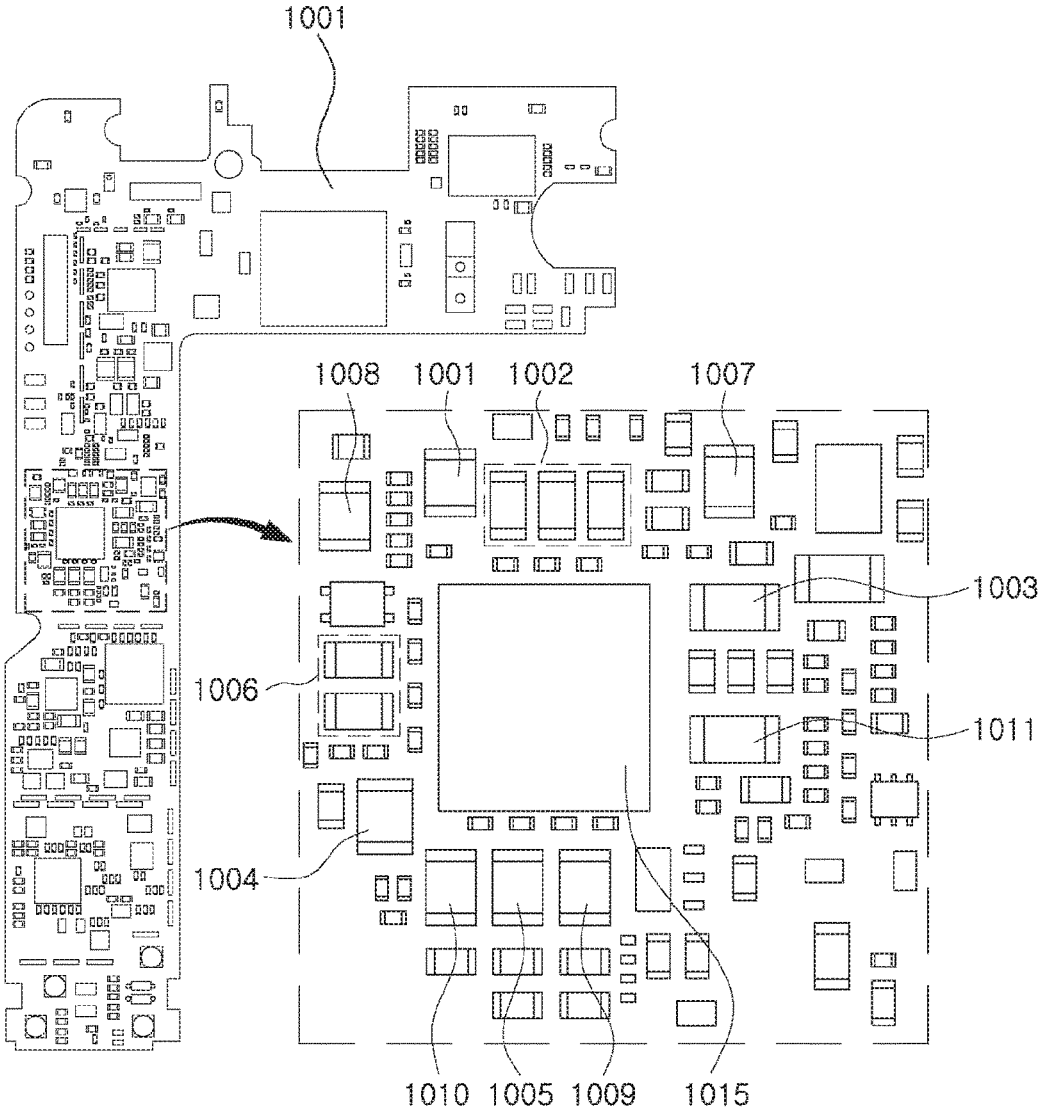
FIG. 2 is a view further illustrating examples of coil components used in a smartphone.

FIG. 2 is a view schematically illustrating various examples of a coil component used in a smartphone.

Referring to FIG. 2, a plurality of components (some of which are not denoted by reference numerals) may be mounted on a mother board 1001 of the smartphone. In this case, coil components used to maintain an output voltage to stabilize power, for example, power inductors 1001 to 1011 having various sizes and forms may be used in the vicinity of a buck power management integrated circuit (PMIC) 1015. Here, the power inductors 1001, 1003 to 1005, and 1007 to 1011 may be single power inductors, and the power inductors 1002 and 1006 may be multiphase power inductors.

An electronic device in which the coil component according to the present disclosure is used may typically be a smartphone as described above, but is not limited thereto. The electronic device may also be, for example, a personal digital assistant, a digital video camera, a digital still camera, a network system, a computer, a monitor, a television, a video game, or a smart watch. The electronic device may also be various other electronic devices well-known in those skilled in the art, in addition to the devices described above.

Coil Component

Hereinafter, a coil component according to the present disclosure, particularly, a power inductor, will be described for convenience of explanation. However, the coil component according to the present disclosure may also be applied as the coil components for various purposes as described above.

Figure 3:
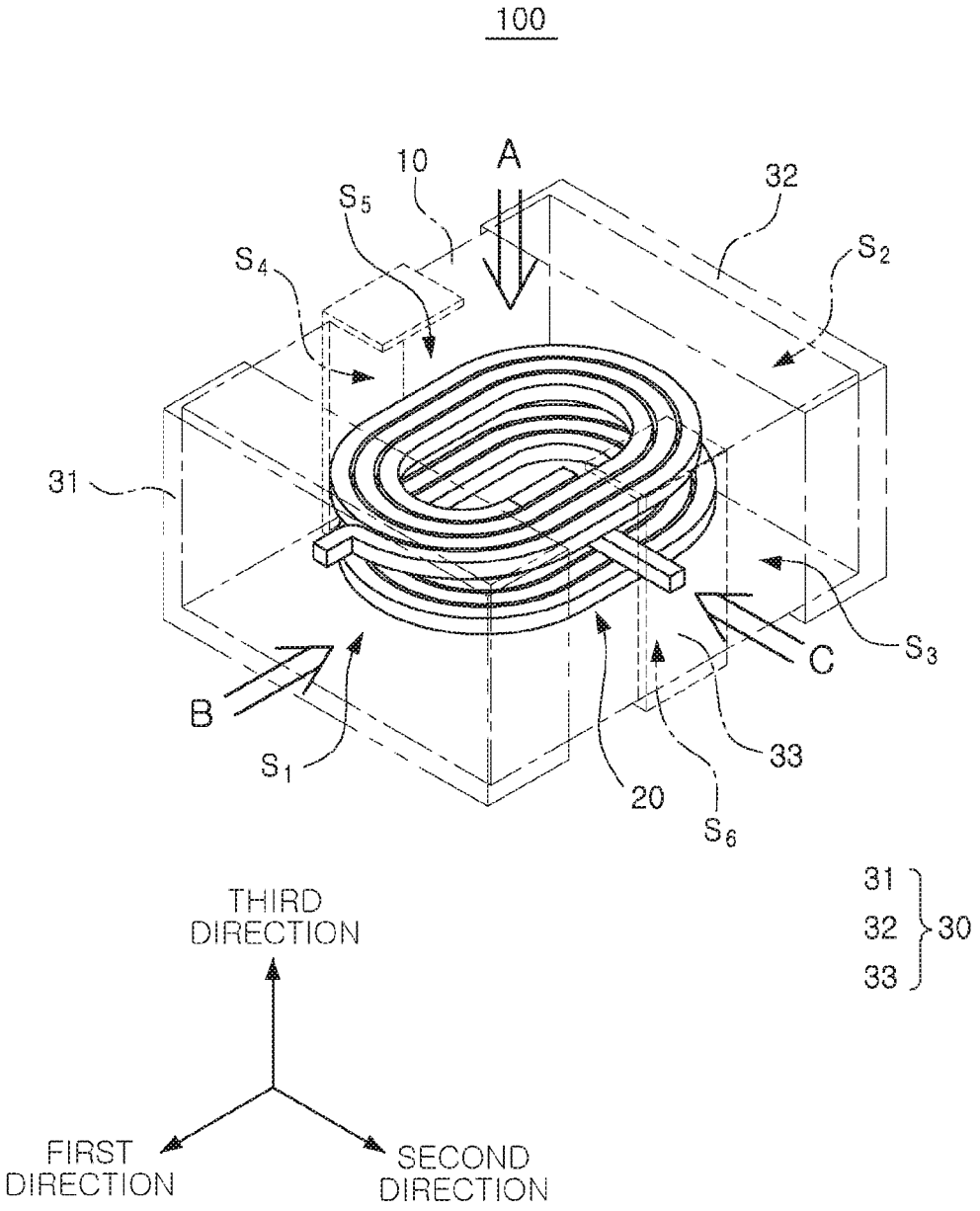
FIG. 3 is a schematic perspective view illustrating a coil component according to an exemplary embodiment in the present disclosure.

FIG. 3 is a schematic perspective view illustrating a coil component according to an exemplary embodiment in the present disclosure.

Referring to FIG. 3, a coil component 100 according to the exemplary embodiment may include a body 10, a coil 20 disposed within the body 10, and an electrode 30 disposed on the body 10.

The body 10 may form an exterior of the coil component 100, and may have a first surface $S_1$ and a second surface $S_2$ opposing each other in a first direction, a third surface $S_3$ and a fourth surface $S_4$ opposing each other in a second direction, and a fifth surface $S_5$ and a sixth surface $S_6$ opposing each other in a third direction. The body 10 may have a hexahedral shape. However, a shape of the body 10 is not limited thereto.

The body 10 may contain a magnetic material having magnetic properties. For example, the body 10 may be formed by mixing ferrite or metal magnetic particles with a resin. The ferrite may be a material such as an Mn—Zn based ferrite, an Ni—Zn based ferrite, an Ni—Zn—Cu based ferrite, an Mn—Mg based ferrite, a Ba based ferrite, an Li based ferrite, or the like. The metal magnetic particle may contain one or more selected from the group consisting of iron (Fe), silicon (Si), chromium (Cr), aluminum (Al), and nickel (Ni). For example, the metal magnetic particle may be a Fe—Si—B—Cr based amorphous metal, but is not necessarily limited thereto. The metal magnetic particle may have a diameter of about 0.1 to 30 μm. The body 10 may have a form in which the ferrite or metal magnetic particles are dispersed in a thermosetting resin such as an epoxy resin, a polyimide resin, or the like.

The magnetic material of the body 10 may be a magnetic material-resin composite in which metal magnetic powder particles and a resin mixture are mixed with each other. The metal magnetic powder particles may contain iron (Fe), chromium (Cr), or silicon (Si) as a main component. For example, the metal magnetic powder particles may contain iron (Fe)-nickel (Ni), iron (Fe), iron (Fe)-chromium (Cr)-silicon (Si), or the like, are not limited thereto. The resin mixture may contain epoxy, polyimide, liquid crystal polymer (LCP), or the like, but is not limited thereto. The metal magnetic powder particles may be metal magnetic powder particles having at least two average particle sizes. In this case, metal magnetic powder particles having different sizes may be fully filled in the magnetic material-resin composite, such that a packing factor of the magnetic material-resin composite may be increased.

The coil 20 may perform various functions in the electronic device through a property appearing in a coil of the coil component 100. For example, the coil component 100 may be a power inductor. In this case, the coil may serve to store electricity in magnetic field form to maintain an output voltage, thereby stabilizing power. A through-hole (not denoted by a reference numeral) may be formed in a central portion of the coil 20, and may be filled with the magnetic material configuring the body 10. A detailed description for the coil 20 will be provided below.

The electrode 30 may serve to electrically connect the coil component 100 to the electronic device when the coil component 100 is mounted on the electronic device. The electrode 30 may include first to third electrode conductors 31 to 33 disposed on the body 10 to be spaced apart from each other. The first electrode conductor 31 may cover the first surface $S_1$ of the body 10, and may be extended to portions of the third surface $S_3$, the fourth surface $S_4$, the fifth surface $S_5$, and the sixth surface $S_6$. The first electrode conductor 31 may be connected to a lead terminal of the coil 20 led out to the first surface $S_1$ of the body 10. The second electrode conductor 32 may cover the second surface $S_2$ of the body 10, and may be extended to portions of the third surface $S_3$, the fourth surface $S_4$, the fifth surface $S_5$, and the sixth surface $S_6$. The second electrode conductor 32 may be connected to a lead terminal of the coil 20 led out to the second surface $S_2$ of the body 10. The third electrode conductor 33 may enclose portions of the third surface $S_3$, the fourth surface $S_4$, the fifth surface $S_5$, and the sixth surface $S_6$ of the body 10. The third electrode conductor 33 may be connected to a lead terminal of the coil 20 led out to the third surface $S_3$ of the body 10.

The electrode 30 may include a conductive resin layer and a conductor layer formed on the conductive resin layer. The conductive resin layer may be formed by printing paste, and may contain one or more conductive metals selected from the group consisting of copper (Cu), nickel (Ni), and silver (Ag), and a thermosetting resin. The conductor layer may contain one or more selected from the group consisting of nickel (Ni), copper (Cu), and tin (Sn). For example, a nickel (Ni) layer and a tin (Sn) layer may be sequentially formed in the conductor layer by plating.

The electrode 30 may include a pre-plating layer (not illustrated) in order to improve electrical reliability between the coil 20 and the electrode 30, if necessary. The pre-plating layer (not illustrated) may be formed by plating a conductive material, for example, copper (Cu). The electrode 30 may be formed by applying at least one of nickel (Ni) and tin (Sn) to the pre-plating layer (not illustrated) or may be formed by applying at least one of silver (Ag) and copper (Cu) to the pre-plating layer (not illustrated) and then applying at least one of nickel (Ni) and tin (Sn). Therefore, a contact area of the electrode 30 may be increased, and silver (Ag), copper (Cu), and the like, for forming the electrode 30, do not need to be separately applied.

Figure 4:
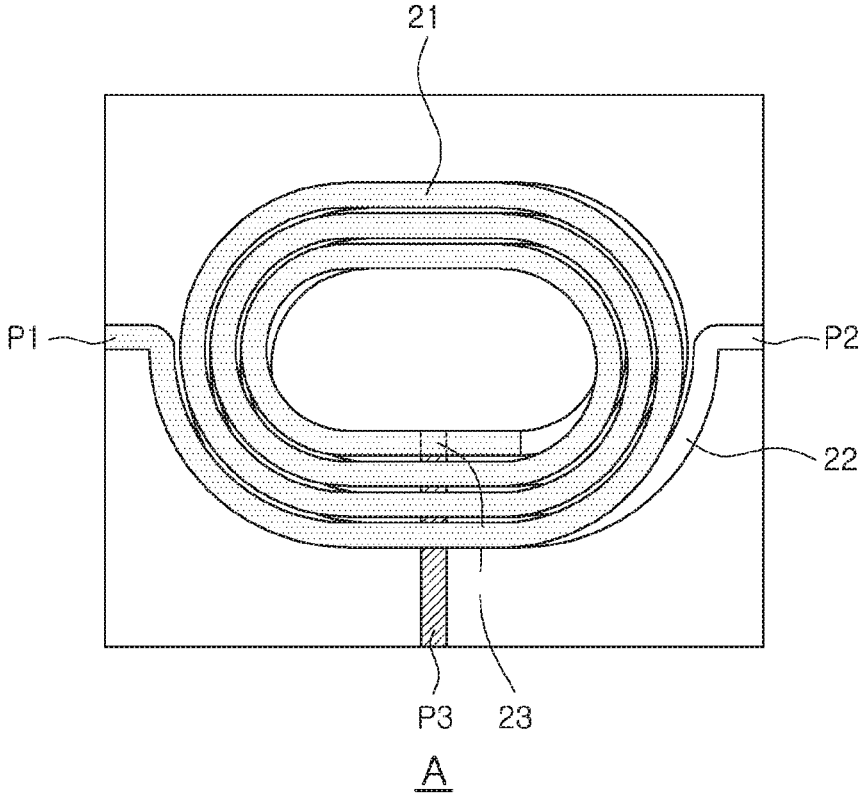
FIG. 4 is a schematic enlarged cross-sectional view of a coil of the coil component of FIG. 3 viewed in direction A.

FIG. 4 is a schematic enlarged cross-sectional view of a coil of the coil component of FIG. 3 viewed in direction A.

Figure 5:
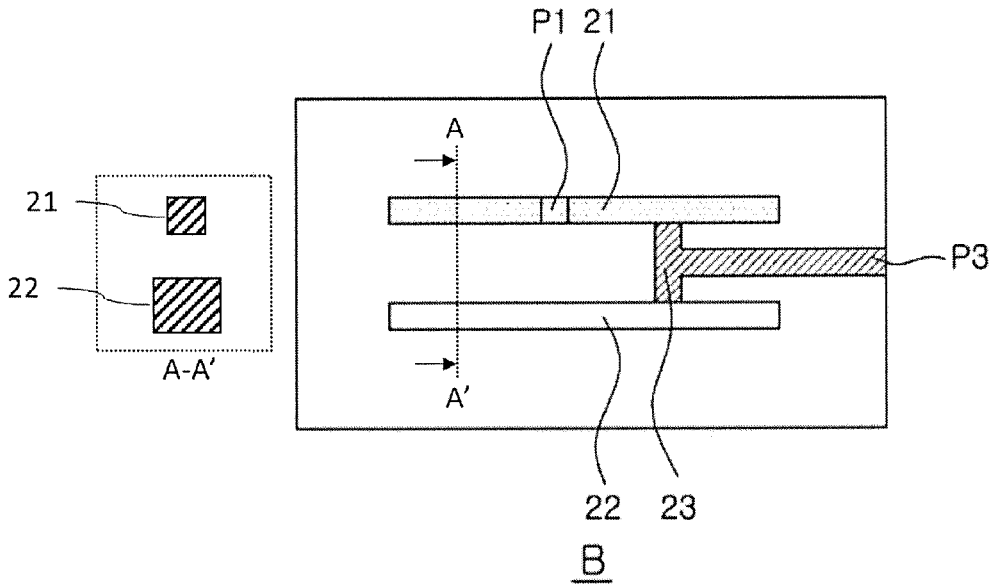
FIG. 5 is a schematic enlarged cross-sectional view of a coil of the coil component of FIG. 3 viewed in direction B.

FIG. 5 is a schematic enlarged cross-sectional view of a coil of the coil component of FIG. 3 viewed in direction B.

Figure 6:
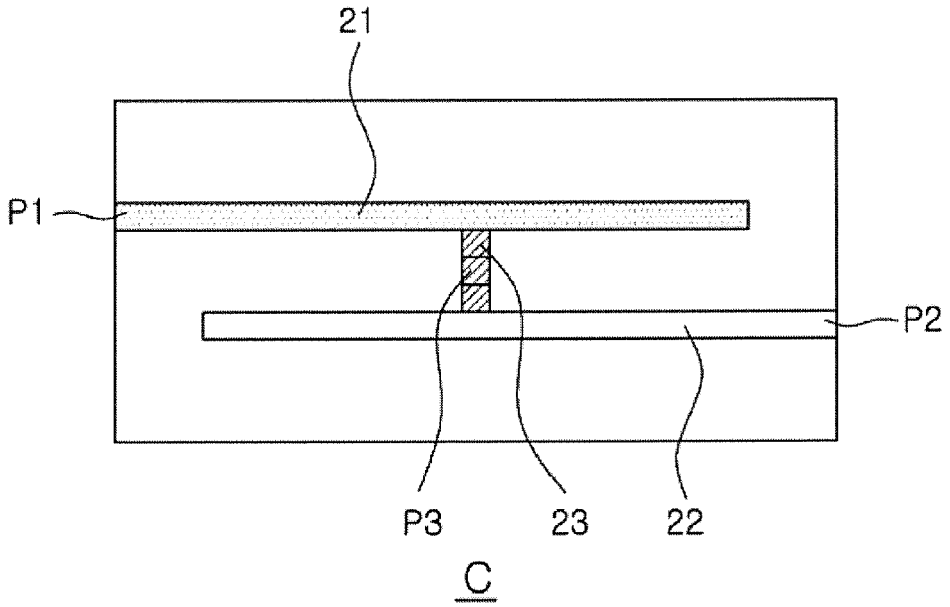
FIG. 6 is a schematic enlarged cross-sectional view of a coil of the coil component of FIG. 3 viewed in direction C.

FIG. 6 is a schematic enlarged cross-sectional view of a coil of the coil component of FIG. 3 viewed in direction C.

Referring to FIGS. 4 through 6, the coil 20 may include a first coil conductor 21 having a first conductor pattern with a planar coil shape and having a first lead terminal P1 led out to the first surface $S_1$ of the body 10, a second coil conductor 22 having a second conductor pattern with a planar coil shape and having a second lead terminal P2 led out to the second surface $S_2$ of the body 10, and a connection conductor 23 disposed between the first and second coil conductors 21 and 22 to connect the first and second coil conductors 21 and 22 to each other and having a third lead terminal P3 led out to the third surface $S_3$ of the body 10.

The first coil conductor 21 may have the first conductor pattern with the planar coil shape. The first conductor pattern may be a plating pattern formed by a general plating method, but is not limited thereto. Since the first conductor pattern may have at least two turns, the first conductor pattern may be thin and implement a high inductance. The first conductor pattern may include a seed layer and a plating layer. The seed layer may include a plurality of layers. For example, the seed layer may include an adhesion layer containing one or more of titanium (Ti), titanium-tungsten (Ti—W), molybdenum (Mo), chromium (Cr), nickel (Ni), and nickel-chromium (Ni—Cr), and a base plating layer disposed on the adhesion layer and containing the same material as that of the plating layer, for example, copper (Cu), but is not limited thereto. The plating layer may contain a conductive material, for example, copper (Cu), aluminum (Al), silver (Ag), tin (Sn), gold (Au), nickel (Ni), lead (Pd), or alloys thereof, and may generally contain copper (Cu), but is not limited thereto.

The first coil conductor 21 may have the first lead terminal P1. The first lead terminal P1 may also be a plating pattern formed by a general plating method, but is not limited thereto. The first lead terminal P1 may be led out to the first surface $S_1$ of the body 10 to thereby be connected to the first electrode conductor 31. However, the first lead terminal P1 is not necessarily limited thereto, but may also be led out to another surface of the body 10 to thereby be connected to the first electrode conductor 31. The first lead terminal P1 may also include a seed layer and a plating layer. The seed layer may include a plurality of layers. For example, the seed layer may include an adhesion layer containing one or more of titanium (Ti), titanium-tungsten (Ti—W), molybdenum (Mo), chromium (Cr), nickel (Ni), and nickel-chromium (Ni—Cr), and a base plating layer disposed on the adhesion layer and containing the same material as that of the plating layer, for example, copper (Cu), but is not limited thereto. The plating layer may contain a conductive material, for example, copper (Cu), aluminum (Al), silver (Ag), tin (Sn), gold (Au), nickel (Ni), lead (Pd), or alloys thereof, and may generally contain copper (Cu), but is not limited thereto.

The second coil conductor 22 may have the second conductor pattern with the planar coil shape. The second conductor pattern may be a plating pattern formed by a general plating method, but is not limited thereto. Since the second conductor pattern may have at least two turns, the second conductor pattern may be thin and implement a high inductance. The second conductor pattern may include a seed layer and a plating layer. The seed layer may include a plurality of layers. For example, the seed layer may include an adhesion layer containing one or more of titanium (Ti), titanium-tungsten (Ti—W), molybdenum (Mo), chromium (Cr), nickel (Ni), and nickel-chromium (Ni—Cr), and a base plating layer disposed on the adhesion layer and containing the same material as that of the plating layer, for example, copper (Cu), but is not limited thereto. The plating layer may contain a conductive material, for example, copper (Cu), aluminum (Al), silver (Ag), tin (Sn), gold (Au), nickel (Ni), lead (Pd), or alloys thereof, and may generally contain copper (Cu), but is not limited thereto.

The second coil conductor 22 may have the second lead terminal P2. The second lead terminal P2 may also be a plating pattern formed by a general plating method, but is not limited thereto. The second lead terminal P2 may be led out to the second surface $S_2$ of the body 10 to thereby be connected to the second electrode conductor 32. However, the second lead terminal P2 is not necessarily limited thereto, but may also be led out to another surface of the body 10 to thereby be connected to the second electrode conductor 32. The second lead terminal P2 may also include a seed layer and a plating layer. The seed layer may include a plurality of layers. For example, the seed layer may include an adhesion layer containing one or more of titanium (Ti), titanium-tungsten (Ti—W), molybdenum (Mo), chromium (Cr), nickel (Ni), and nickel-chromium (Ni—Cr), and a base plating layer disposed on the adhesion layer and containing the same material as that of the plating layer, for example, copper (Cu), but is not limited thereto. The plating layer may contain a conductive material, for example, copper (Cu), aluminum (Al), silver (Ag), tin (Sn), gold (Au), nickel (Ni), lead (Pd), or alloys thereof, and may generally contain copper (Cu), but is not limited thereto.

The connection conductor 23 may electrically connect the first coil conductor 21 and the second coil conductor 22 to each other. As a result, the first coil conductor 21 and the second coil conductor 22 may be connected to each other in series to form a coil 20 rotated in the same direction. The connection conductor 23 may be a plating pattern formed by a general plating method, but is not limited thereto. An insulating material such as a support member (not illustrated), or the like, may be present between the first coil conductor 21 and the second coil conductor 22. In this case, the connection conductor 23 may penetrate through the insulating material. The connection conductor 23 may include a seed layer and a plating layer. The seed layer may include a plurality of layers. For example, the seed layer may include an adhesion layer containing one or more of titanium (Ti), titanium-tungsten (Ti—W), molybdenum (Mo), chromium (Cr), nickel (Ni), and nickel-chromium (Ni—Cr), and a base plating layer disposed on the adhesion layer and containing the same material as that of the plating layer, for example, copper (Cu), but is not limited thereto. The plating layer may contain a conductive material, for example, copper (Cu), aluminum (Al), silver (Ag), tin (Sn), gold (Au), nickel (Ni), lead (Pd), or alloys thereof, and may generally contain copper (Cu), but is not limited thereto.

The connection conductor 23 may have the third lead terminal P3. The third lead terminal P3 may also be a plating pattern formed by a general plating method, but is not limited thereto. The third lead terminal P3 may be led out to the third surface $S_3$ of the body 10 to thereby be connected to the third electrode conductor 33. However, the third lead terminal P3 is not necessarily limited thereto, but may also be led out to another surface of the body 10 to thereby be connected to the third electrode conductor 33. The third lead terminal P3 may also include a seed layer and a plating layer. The seed layer may include a plurality of layers. For example, the seed layer may include an adhesion layer containing one or more of titanium (Ti), titanium-tungsten (Ti—W), molybdenum (Mo), chromium (Cr), nickel (Ni), and nickel-chromium (Ni—Cr), and a base plating layer disposed on the adhesion layer and containing the same material as that of the plating layer, for example, copper (Cu), but is not limited thereto. The plating layer may contain a conductive material, for example, copper (Cu), aluminum (Al), silver (Ag), tin (Sn), gold (Au), nickel (Ni), lead (Pd), or alloys thereof, and may generally contain copper (Cu), but is not limited thereto.

Figure 7:
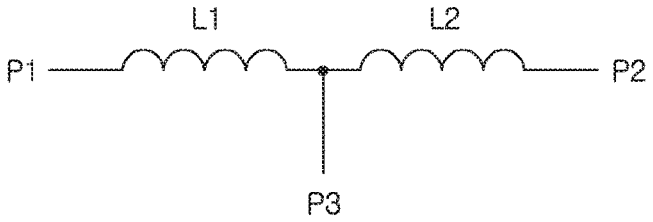
FIG. 7 is a view schematically illustrating an equivalent circuit of the coil component of FIG. 3.

FIG. 7 is a view schematically illustrating an equivalent circuit of the coil component of FIG. 3.

Figure 8:
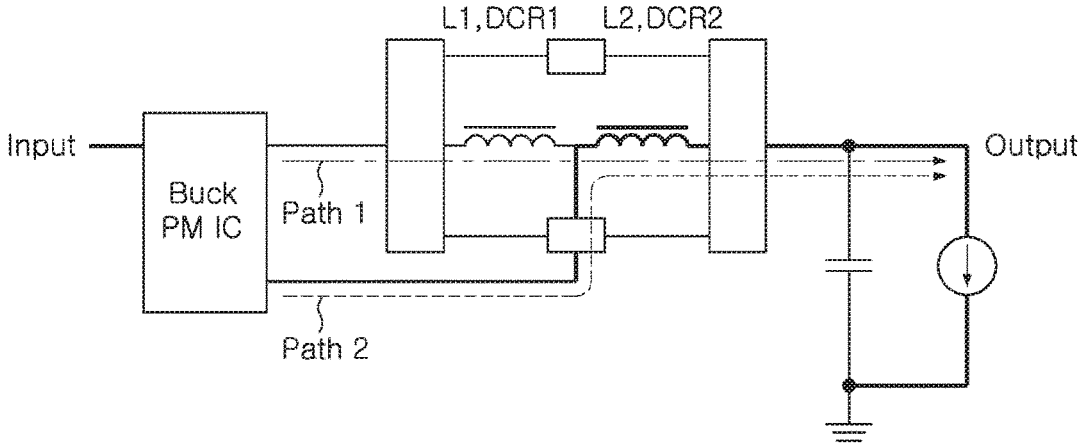
FIG. 8 is a view schematically illustrating an equivalent circuit in a case in which the coil component of FIG. 3 is used in an electronic device.

FIG. 8 is a view schematically illustrating an equivalent circuit in a case in which the coil component of FIG. 3 is used in an electronic device.

Referring to FIGS. 7 and 8, the first coil conductor 21 and the second coil conductor 22 may have a first inductance L1 and a second inductance L2, respectively. The first coil conductor 21 and the second coil conductor 22 may have a first DC resistance DCR1 and a second DC resistance DCR2, respectively. The first coil conductor 21 and the second coil conductor 22 may be connected to each other in series by the connection conductor 23 to configure one coil 20. The coil 20 including the first coil conductor 21 and the second coil conductor 22 connected to each other in series may be connected to the outside of the first lead terminal P1, the second lead terminal P2, and the third lead terminal P3.

The first inductance L1 and the second inductance L2 may have substantially the same value. For example, a difference between the first inductance L1 and the second inductance L2 may be 0.1 μH or less. The first DC resistance DCR1 and the second DC resistance DCR2 may have different values. For example, a difference between the first DC resistance DCR1 and the second DC resistance DCR2 may be 40 mΩ or more. A difference between levels of DC resistance may be implemented by, for example, designing a cross-sectional area of the first conductor pattern of the first coil conductor 21 to be very small and designing a cross-sectional area of the second conductor pattern of the second coil conductor 22 to be very wide. Here, the cross-sectional area refers to a value obtained by multiplying a line width of the conductor pattern by a height of the conductor pattern. The first and second levels of inductance may become similar to each other by a method of allowing the turn of the first conductor pattern of the first coil conductor 21 to be more than that of the second conductor pattern of the second coil conductor 22.

In this case, both of an inductance and a DC resistance in a low current (Path 1) section may be larger than those in a high current (Path 2) section. That is, in the low current (Path 1) section, an inductance L may be increased to significantly reduce AC loss, and in the high current (Path 2) section, a DC resistance (RDC) may be reduced to significantly reduce DC loss. That is, efficiency of the power inductor may be significantly improved depending on a condition of a current by making paths of the low current (Path1, L1+L2, DCR1+DCR2) section and the high current (Path 2, L2, DCR2) section different from each other.

Figure 9:
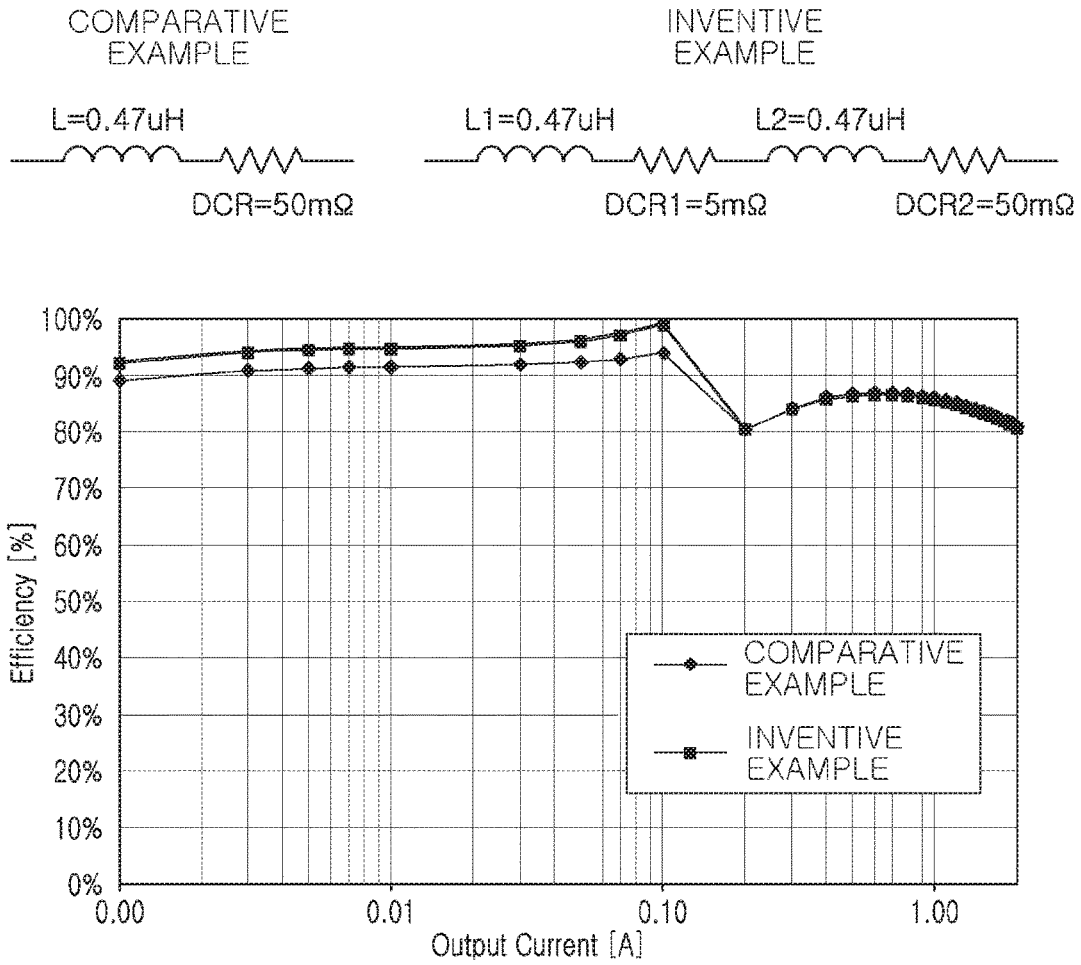
FIG. 9 is a view schematically illustrating an efficiency improvement effect in the case in which the coil component of FIG. 3 is used in an electronic device.

FIG. 9 is a view schematically illustrating an efficiency improvement effect in the case in which the coil component of FIG. 3 is used in an electronic device.

Referring to FIG. 9, it may be appreciated that efficiency in a low current band as well as efficiency in a high current band are improved in a power inductor according to the Inventive Example, that is, a power inductor according to the present disclosure in which a first coil conductor (L1=0.47 μH, DCR=5 mΩ) and a second coil conductor (L=0.47 μH, DCR=50 mΩ) having similar inductance (L) values and different DC resistance (RDC) values are connected to each other in series as compared to in a power inductor according to the Comparative Example, that is, a general power inductor having only one coil conductor (L=0.47 μH, DCR=5 mΩ). In addition, since the power inductor according to the present disclosure is formed of one coil, a mounting area and a surface mounted technology (SMT) process cost of the power inductor may be reduced at the time of mounting the power inductor on the electronic device as compared to in a case in which a plurality of coils are connected to each other in series.

Figure 10:
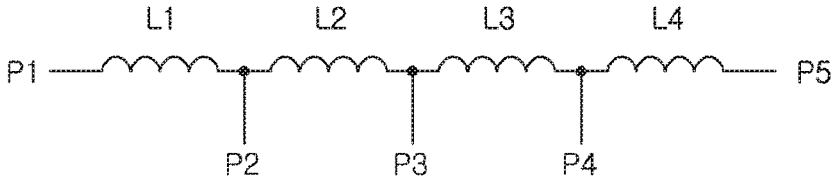
FIG. 10 is a view schematically illustrating an equivalent circuit of a coil component according to another example.

FIG. 10 is a view schematically illustrating an equivalent circuit of a coil component according to another example.

Referring to FIG. 10, a coil component according to another example may be a coil component in which first to fourth coil conductors having first to fourth levels of inductance L1 to L4, respectively, are connected to each other in series. In this case, the coil component may be connected to the outside through first to fifth lead terminals P1 to P5. That is, the coil component according to the present disclosure is not necessarily limited to a case in which two coil conductors are connected to each other in series, but may be extended to a case in which two or more coil conductors are connected to each other in series. This generally means that a coil of the coil component may be an array of N coil conductors. In this case, the coil may have N+1 lead terminals. Here, N indicates an integer of 2 or more.

Meanwhile, in the present disclosure, a phrase 'electrically connected' includes both of a case in which one component is physically connected to another component and a case in which one component is not physically connected to another component. In addition, terms 'first', 'second', and the like, are used to distinguish one component from another component, and do not limit a sequence, importance, and the like, of the corresponding components. In some cases, a first component may be termed a second component and a second component may also be similarly termed a first component, without departing from the scope of the present disclosure.

In addition, a phrase 'example' used in the present disclosure does not mean the same exemplary embodiment, but is provided in order to emphasize and describe different unique features. However, the above suggested examples may also be implemented to be combined with a feature of another example. For example, even though particulars described in a specific example are not described in another example, it may be understood as a description related to another example unless described otherwise.

In addition, terms used in the present disclosure are used only in order to describe an example rather than limiting the present disclosure. Here, singular forms include plural forms unless interpreted otherwise in a context.

As set forth above, according to an exemplary embodiment in the present disclosure, efficiency of a coil component over an entire band from a low current to a high current may be improved.

While exemplary embodiments have been shown and described above, it will be apparent to those skilled in the art that modifications and variations could be made without departing from the scope of the present invention as defined by the appended claims.

What is claimed is:

1. A coil component comprising:

a body;

an electrode disposed on the body; and a coil disposed within the body, wherein the coil includes:

a first coil conductor including a first conductor pattern with a planar coil shape and a first lead terminal extended to at least one surface of the body;

a second coil conductor including a second conductor pattern with a planar coil shape and a second lead terminal extended to at least one surface of the body;

a connection conductor connecting the first and second coil conductors to each other and including a third lead terminal extended to at least one surface of the body; and an insulating material disposed between the first and second coil conductors, wherein the connection conductor penetrates the insulating material, wherein the connection conductor includes a vertical portion connecting the first and second coil conductors and a horizontal straight portion, one end of the horizontal straight portion directly connected to the vertical portion, and another end of the horizontal straight portion connected to the electrode, and wherein the first conductor pattern has a cross-sectional area smaller than that of the second conductor pattern.

2. The coil component of claim 1, wherein the first and second coil conductors are connected to each other in series.

3. The coil component of claim 2, wherein the first and second coil conductors have different levels of direct current (DC) resistance.

4. The coil component of claim 3, wherein a difference between the levels of DC resistance of the first and second coil conductors is 40 mΩ or more.

5. The coil component of claim 2, wherein the first and second coil conductors have substantially the same level of inductance (L).

6. The coil component of claim 5, wherein a difference between the levels of inductance (L) of the first and second coil conductors is 0.1 μH or less.

7. The coil component of claim 2, wherein the first coil conductor has a larger level of DC resistance than the second coil conductor.

8. The coil component of claim 1, wherein the coil has N coil conductors and N+1 lead terminals, where N is an integer having a value of 2 or more.

9. The coil component of claim 1, wherein the electrode includes:

a first electrode conductor connected to the first lead terminal;

a second electrode conductor connected to the second lead terminal; and a third electrode conductor connected to the third lead terminal.

10. The coil component of claim 9, wherein the first, second and third electrode conductors are disposed to be spaced apart from each other.

11. The coil component of claim 1, wherein the body is formed of a magnetic material-resin composite containing at least two metal magnetic powder particles having different average particle sizes and a resin mixture.

12. The coil component of claim 11, wherein the resin mixture contains epoxy, polyimide, or a liquid crystal polymer (LCP).

13. The coil component of claim 11, wherein the metal magnetic powder particles contain iron (Fe), chromium (Cr), or silicon (Si).

14. A coil component comprising:

a body having a first surface and a second surface opposing each other in a first direction, a third surface and a fourth surface opposing each other in a second direction, and a fifth surface and a sixth surface opposing each other in a third direction;

a coil disposed within the body and including a first coil conductor having a first conductor pattern with a planar coil shape and having a first lead terminal led out to the first surface of the body, a second coil conductor having a second conductor pattern with a planar coil shape and having a second lead terminal led out to the second surface of the body, and a connection conductor disposed between the first and second coil conductors to connect the first and second coil conductors to each other and having a third lead terminal led out to the third surface of the body;

an electrode disposed on the body and including a first electrode conductor entirely covering the first surface of the body and portions of the third to sixth surfaces of the body, a second electrode conductor entirely covering the second surface of the body and portions of the third to sixth surfaces of the body, and a third electrode conductor covering portions of the third, fourth, fifth and sixth surfaces of the body; and an insulating material disposed between the first and second coil conductors, wherein the connection conductor penetrates the insulating material, wherein the connection conductor includes a vertical portion connecting the first and second coil conductors and a horizontal straight portion, one end of the horizontal straight portion directly connected to the vertical portion, and another end of the horizontal straight portion connected to the electrode, and wherein the first conductor pattern has a cross-sectional area smaller than that of the second conductor pattern.

15. The coil component of claim 14, wherein the first and second coil conductors are connected to each other in series.

* * * * *